US005429175A

United States Patent [19]

Thieman et al.

[11] Patent Number: 5,429,175

[45] Date of Patent: Jul. 4, 1995

[54] VERTICAL DIE CASTING PRESS AND METHOD OF OPERATION

[75] Inventors: Ted H. Thieman; Richard J. Kamm, both of Dayton, Ohio

[73] Assignee: THT Presses Inc., Dayton, Ohio

[21] Appl. No.: 84,136

[22] Filed: Jul. 1, 1993

[51] Int. Cl.[6] ..... B22D 17/22; B22D 17/26

[52] U.S. Cl. ..... 164/312; 164/341; 164/347

[58] Field of Search ..... 164/113, 312, 305, 137, 164/342, 341, 347, 343

[56] References Cited

U.S. PATENT DOCUMENTS

| | | | |
|---|---|---|---|
| 2,689,978 | 9/1954 | Roger | 164/342 |
| 2,741,006 | 4/1956 | Kux . | |
| 2,938,250 | 5/1960 | Larsh et al. . | |
| 3,209,416 | 10/1965 | Morton | 164/347 |
| 3,315,315 | 4/1967 | Triulzi . | |
| 3,584,345 | 6/1971 | Beastrom . | |
| 3,596,708 | 8/1971 | Lapin | 164/312 |
| 4,059,143 | 11/1977 | Morita et al. | 164/312 |
| 4,754,801 | 7/1988 | Ueno et al. | 164/312 |
| 4,993,474 | 2/1991 | Uchida | 164/342 |
| 5,035,606 | 7/1991 | Zakich | 164/341 |
| 5,269,364 | 12/1993 | Murata | 164/342 |
| 5,277,551 | 1/1994 | Slepian et al. | 417/50 |

FOREIGN PATENT DOCUMENTS

| | | | |
|---|---|---|---|
| 0128258 | 7/1983 | Japan | 164/312 |
| 0102259 | 6/1985 | Japan | 164/113 |
| 61-82958 | 4/1986 | Japan | 164/312 |
| 1222667 | 10/1986 | Japan | 164/312 |
| 2207552 | 9/1987 | Japan | 164/312 |
| 8059784 | 11/1988 | Japan | 164/113 |

OTHER PUBLICATIONS

Kux Vert-A-Cast, Wickes Machinery, Bulletin VC-300.

THT Vertical Die Cast Presses, THT Presses Inc.

*Primary Examiner*—Kuang Y. Lin

*Attorney, Agent, or Firm*—Jacox & Meckstroth

[57] ABSTRACT

A vertical die casting press includes a frame supporting a stationary lower horizontal platen which supports a base plate attached to a lower mold. An upper horizontal platen is supported for vertical movement between vertical columns by corner lift cylinders mounted on the lower platen, and the upper platen encloses hydraulic cylinders for actuating blades for releasably locking the upper platen to teeth on the vertical columns at a selected height. The upper platen carries a relatively movable intermediate platen which supports a base plate attached to an upper mold. After the upper platen is locked to the columns, a hydraulic load cell or cylinder within the upper platen clamps the intermediate platen and upper mold to the lower mold and lower platen. Molten die cast material is transferred through a horizontal ceramic cylinder from a ladle inlet to a vertical shot cylinder within the lower platen and lower mold, and a shot piston injects the material upwardly from the shot cylinder through runners and into cavities defined by the molds. The intermediate platen and lower platen enclose hydraulic cylinders for extending and retracting a set of rollers which engage tracks within the corresponding base plates to provide for quickly removing and replacing a set of upper and lower molds and corresponding base plates.

10 Claims, 3 Drawing Sheets

VERTICAL DIE CASTING PRESS AND METHOD OF OPERATION

BACKGROUND OF THE INVENTION

The present invention relates to a vertical die casting machine or press of the general type manufactured by Applicant's assignee, THT Presses, Inc. In this type press, a frame supports a lower stationary platen and a movable upper platen, and the platens support corresponding lower and upper molds which cooperate to define one or more part defining cavities. The lower platen supports a vertical shot sleeve or cylinder which encloses a shot piston, and the piston moves vertically between a lower retracted position and an upper injection position by a rod extending upwardly from a vertical hydraulic cylinder. The upper platen moves vertically between a lower mold closed position and an upper retracted mold open position by another hydraulic cylinder or set of cylinders.

After the lower mold is shifted laterally on the lower platen by a hydraulic cylinder and the shot piston is retracted downwardly, molten die cast metal or material is poured from an automatically controlled ladle into the chamber defined within the shot cylinder above the shot piston. The lower mold is then shifted laterally to align one or more sprue passages with the shot chamber. The upper platen moves downwardly to close and clamp the upper mold against the lower mold or against a cavity defining part such as a motor rotor confined between the upper and lower molds. The cavity is evacuated, and the shot piston is forced upwardly to inject the molten metal into the mold cavity or cavities. The molds and shot piston are then cooled by circulating water through passages within the molds and shot piston to solidify the die cast material. After the mold is opened, the sprues are retracted downwardly from the lower mold by a sprue connecting biscuit releasably attached to the shot piston. The lower mold is shifted laterally after which the shot piston moves upwardly to provide for removing the sprues and connecting biscuit from the shot piston. The cycle is then repeated for die casting another part or set of parts.

Another form of vertical die casting machine or press is manufactured by Wickes Machinery, a division of The Wickes Corporation. In this die casting machine or press, the molten metal is sucked upwardly through a transfer tube into the shot cylinder by applying a vacuum to the mold cavity. The vacuum also evacuates air from the die cavity or cavities, and the atmospheric air pressure on the molten metal within the furnace pot creates a differential pressure which forces the molten metal upwardly into the shot sleeve. A shot piston then injects the molten metal into the mold cavity or cavities.

In any type of horizontal or vertical die casting machine or press, it is desirable to minimize the cycle time of the die casting operation and to produce high quality parts without voids or porosity. It is also desirable to provide for minimizing the amount of die cast material which solidifies outside the mold cavities in the sprues and mold runners after each cycle is completed. It is also desirable to minimize the pressure at which the molten material is injected into the mold cavities in order to reduce the loading on the press components and the molds and thereby maximize the useful service life of the press and molds.

SUMMARY OF THE PRESENT INVENTION

The present invention is directed to an improved vertical die casting machine or press and which provides all of the desirable advantages and features mentioned above. More specifically, the die cast press of the invention provides for injecting the molten die cast metal or material at a substantially lower pressure, decreases the cycle time for die casting operation, provides for higher quality parts without porosity by degassing the molten material, and minimizes heat loss during transfer of the molten material from the ladle into the mold cavities. The press of the invention also minimizes the time for replacing or interchanging mold sets for producing different parts.

The above features are generally provided by a vertical die casting press having a horizontal lower platen which supports a base plate connected to a lower mold. The frame also supports an upper horizontal platen for vertical movement by a set of corner lift cylinders mounted on the lower platen, and hydraulic cylinders are enclosed within the upper platen for actuating blades which releasably lock the upper platen at a selected height to lock plates mounted on a pair of vertical columns secured to the lower mold. An intermediate platen is movably connected to the upper platen and supports a base plate connected to an upper mold. After the upper platen is locked to the columns, a hydraulic load cell or cylinder within the upper platen clamps the intermediate platen and upper mold to the lower mold and lower platen.

Molten die cast metal is transferred to a vertical shot cylinder within the lower platen and lower mold by a horizontal ceramic transfer cylinder enclosing a hydraulically actuated transfer piston. A shot piston injects the molten material upwardly from the shot cylinder through runners and into cavities defined by the molds. The intermediate and lower platens each encloses a set of hydraulic cylinders for extending and retracting a set of rollers, and the rollers engage tracks within the corresponding mold base plates to provide for quickly removing and replacing a set of upper and lower molds.

Other features and advantages of the invention will be apparent from the following description, the accompanying drawings and the appended claims.

DESCRIPTION OF THE PREFERRED EMBODIMENT

Figure 1:
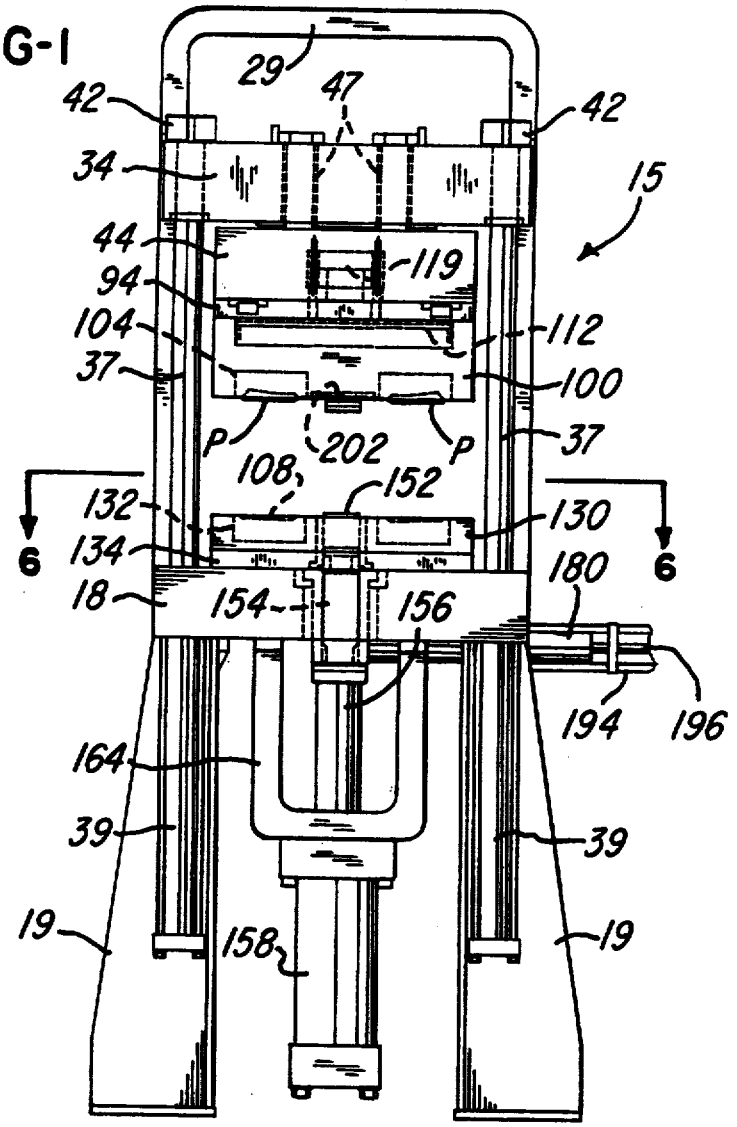
FIG. 1 is an elevational view of a vertical die casting press constructed in accordance with the present invention, and with a portion of a cylinder broken away.
Figure 2:
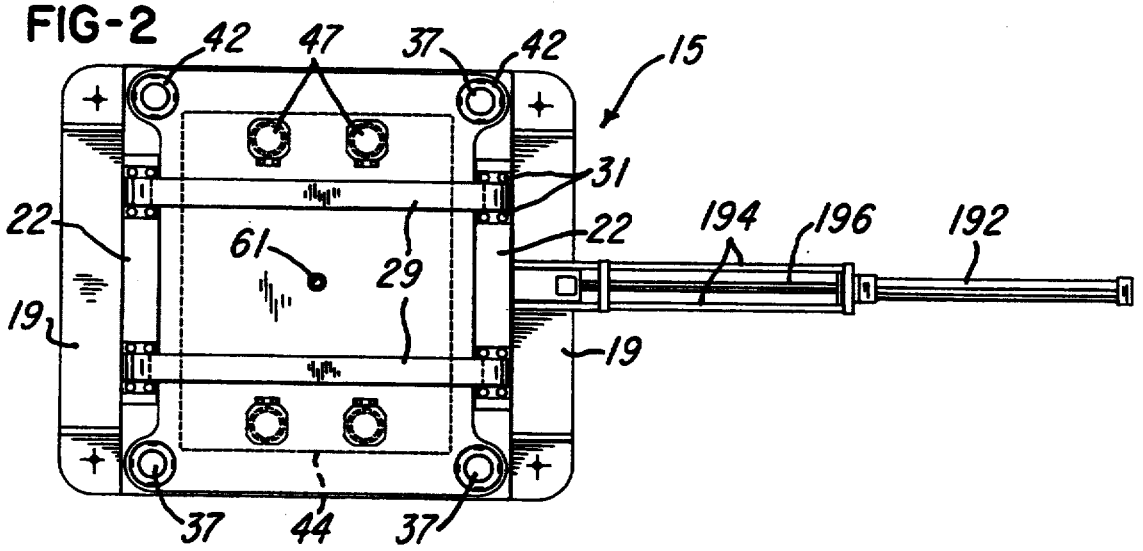
FIG. 2 is a top or plan view of the press shown in FIG. 1.

FIGS. 1 and 2 illustrate a 400 ton vertical die casting machine or press 15 which includes a horizontal lower platen 18 supported on opposite sides by a pair of welded or fabricated leg members or pedestals 19. A pair of generally flat plates or columns 22 (FIG. 3) are each secured to the lower platen 18 by a row of ten screws 23, and a pair of opposing lock plates 26 (FIG. 3) are recessed within the columns 22. Each of the lock plates 26 has a series of vertically spaced horizontal slots or grooves 27, and the upper ends of the columns 22 are rigidly connected by a pair of inverted U-shaped tie bars 29 (FIGS. 1 and 2) each having base plates secured to the top ends of the columns 22 by a set of screws 31.

Figure 6:
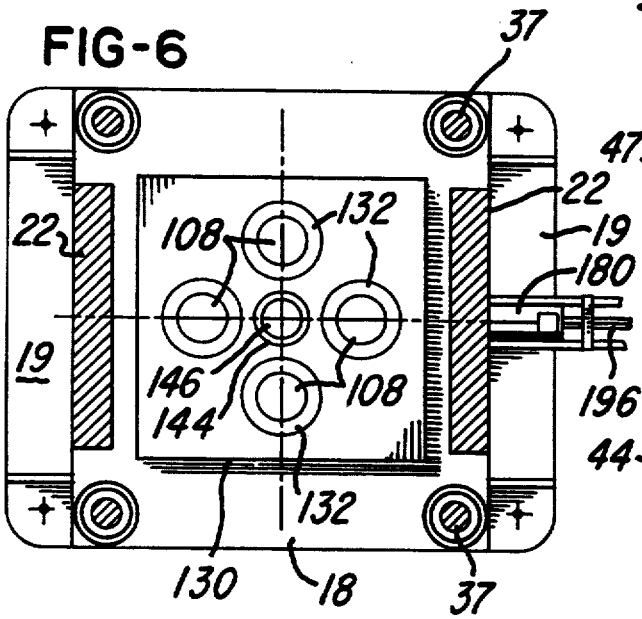
FIG. 6 is a horizontal section taken generally on the line 6—6 of FIG. 1.

A horizontal upper platen 34 is positioned between the columns 22, and the four corners of the upper platen 34 are attached to corresponding vertical rods 37 which are extensions of piston rods (FIG. 6) of corresponding hydraulic lift cylinders 39 mounted on the lower platen 18 and projecting downwardly from the platen. A set of nuts 42 (FIG. 1) are threaded onto the upper end portions of the rods 37 and engage the top surface of the upper platen 34. When the cylinders 39 are actuated to extend and retract the rods 37, the upper platen 34 moves vertically between its upper retracted position (FIG. 1) and its lower clamping position, shown in FIG. 3.

Figure 3:
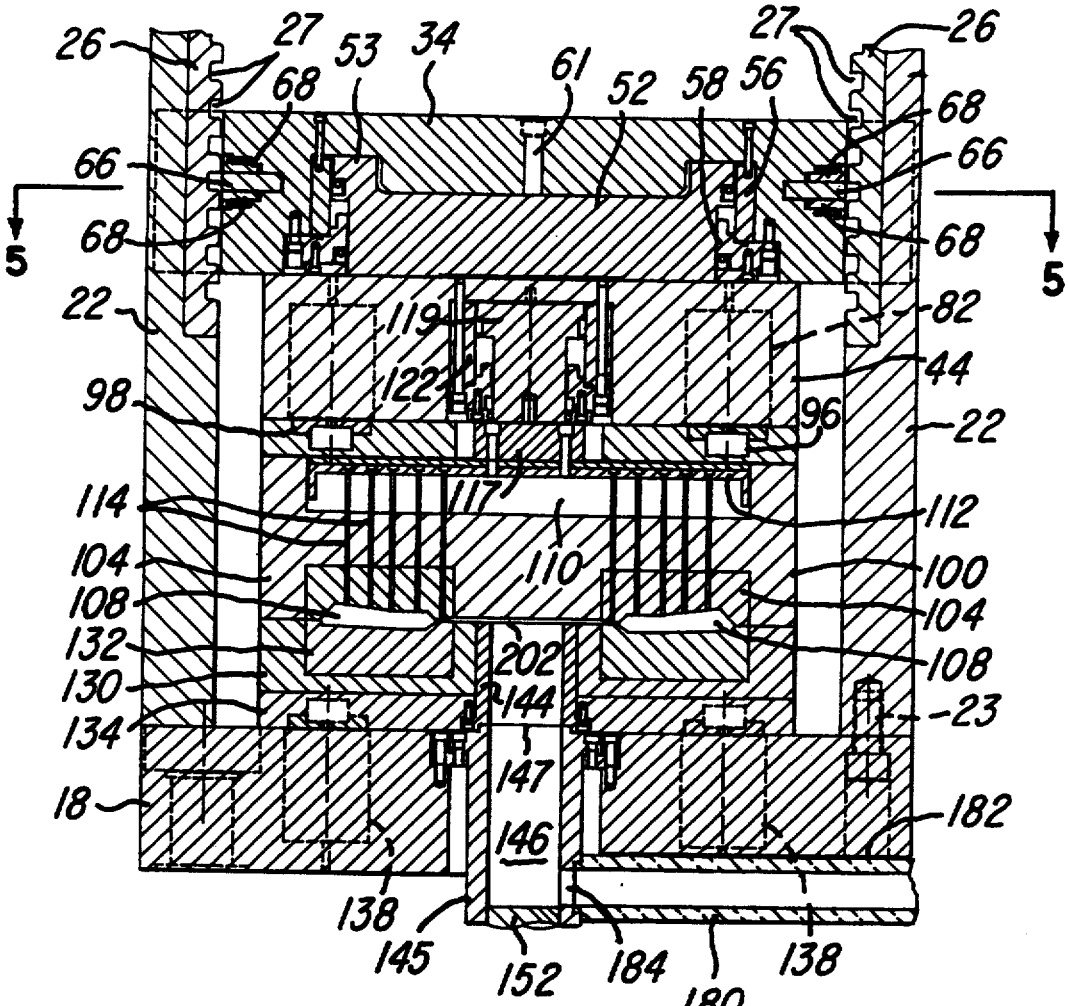
FIG. 3 is an enlarged vertical section of the upper portion of the press shown in FIG. 1.
Figure 5:
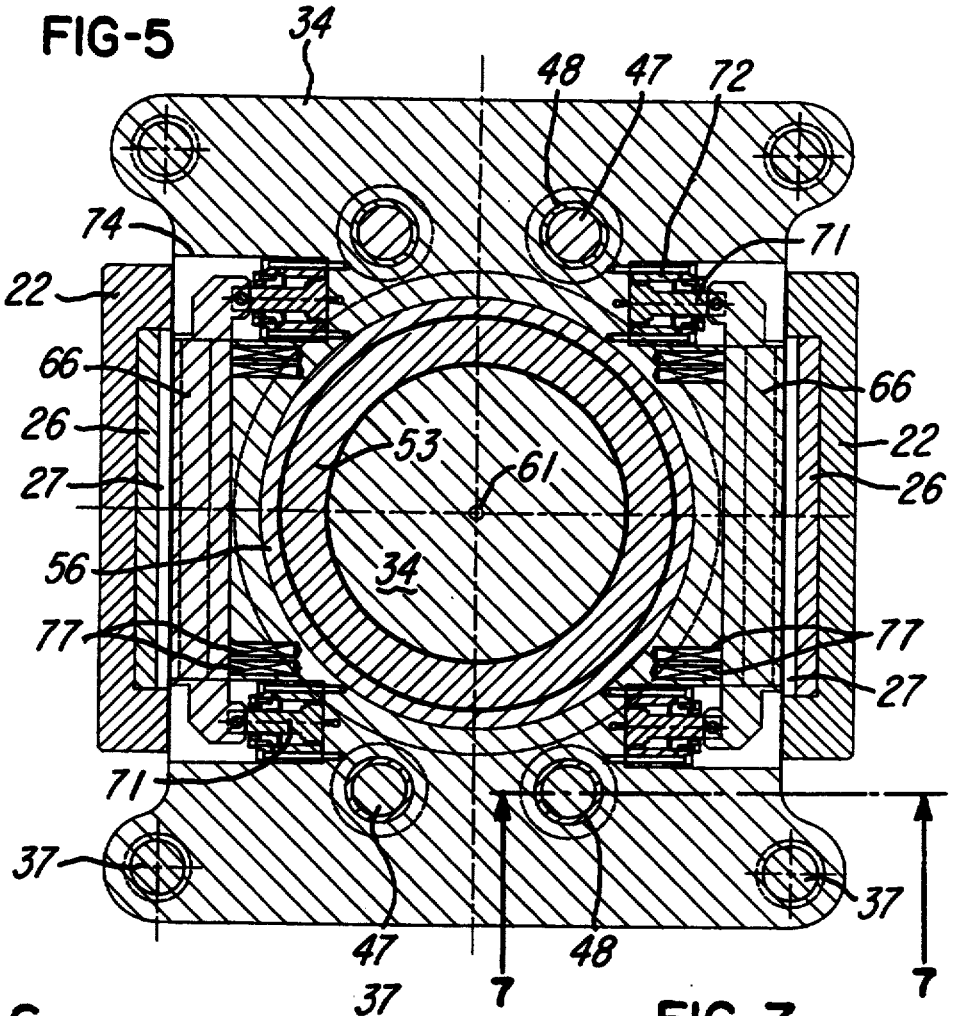
FIG. 5 is a horizontal section of the press, taken generally on the line 5—5 of FIG. 3.
Figure 7:
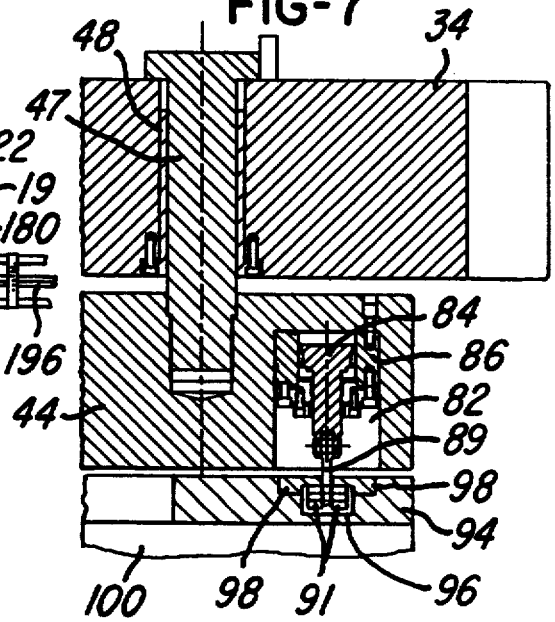
FIG. 7 is an enlarged fragmentary section of the upper and intermediate platens of the press and taken generally on the line 7—7 of FIG. 5.

Referring to FIG. 7, the upper platen 34 supports a horizontal intermediate platen 44 by a set of four retainer rods or pins 47 (FIGS. 5 and 7) which extend downwardly through cylindrical bearings 48 within the upper platen 34 and are threaded into the upper portion of the intermediate platen 44. The pins 47 provide for limited vertical movement of the intermediate platen 44 relative to the upper platen 34. As shown in FIGS. 3 and 5, the upper platen 34 also encloses a large diameter load cell or piston 52 which includes an annular upper portion 53 surrounded by a cylindrical sleeve or cylinder 56. A retaining ring 58 is secured within a counterbore within the lower portion of the upper platen 34 and engages a lower cylindrical portion of the piston 52. Suitable sealing rings are retained within the piston portion 53 and ring 58 for confining hydraulic fluid or oil which is supplied to the top of the piston 52 through a center port 61 within the upper platen 34. Preferably, the piston 52 is capable of receiving hydraulic fluid at a pressure of about 2,000 p.s.i. for producing a downward loading force against the intermediate platen 44 of about 380 tons.

As also shown in FIGS. 3 & 5, a pair of locking bars or blades 66 are supported for horizontal movement between corresponding pairs of bearing plates 68 within opposite edge portions of the upper platen 34. The opposite end portions of each locking bar 66 are pivotally connected to a set of pistons 71 forming part of hydraulic cylinders 72 secured to the upper platen 34 within corresponding cylindrical bores 74. A set of compression springs 77 normally urge each of the locking blades 66 outwardly between the retaining plate 68 and into one of the slots or grooves 27 within the opposing lock plate 26 within the adjacent column 22. When the pistons 71 are actuated or retracted, the locking bars 66 are pulled inwardly against the force of the springs 77 to retracted positions, as shown in FIGS. 3 and 5. When the locking bars 66 are retracted, the upper platen 34 is free to move vertically between the columns 22 in response to actuation of the hydraulic lift cylinders 39.

Referring to FIG. 7, a set of four bores 82 are formed within the corner portions of the intermediate platen 44 and extend upwardly from the bottom surface of the platen for receiving corresponding pistons 84 within hydraulic cylinders 86. A link 89 is pivotally connected to each piston 84 and projects downwardly to support a set of rollers 91. A mold base plate 94 is positioned below the intermediate platen 44 and has a pair of parallel channels 96 each covered partially by a pair of opposing elongated tracks 98 positioned for engaging the rollers 91. The base plate 94 is secured by a set of screws (not shown) to the top of an upper mold 100. A set of mold inserts 104 (FIG. 3) are recessed within the upper mold 100, and each mold insert 104 defines the upper portion of a part defining cavity 108.

A circular cavity or recess 110 is formed within the upper portion of the upper mold 100 and receives a bumper plate 112 which carries a set of vertical knockout pins 114 for each cavity 108. The center portion of plate 112 is mounted on a cylindrical spacer block 117 which is contacted by a piston 119 slidably supported by an injector cylinder 122 secured within a circular bore within the center of the intermediate platen 44. When the upper platen 34, intermediate platen 44 and upper mold 100 are retracted upwardly to a mold open position (FIG. 1), the injector pins 114 are shifted downwardly by actuation of the piston 119 to eject the parts P which are cast or formed within the mold cavities.

A lower mold 130 (FIG. 3) also has a set of mold inserts 132 which define the lower portion of the cavities 108. The lower mold 130 is secured by screws (not shown) to a mold base plate 134 which is constructed the same as the base plate 94. Thus the base plate 134 has two parallel channels 96 and two pairs of tracks 98. The tracks 98 receive corresponding sets of rollers 91 carried by the pistons 84 of a set of hydraulic cylinders 86 recessed within bores 138 formed within the lower platen 18. As also shown in FIG. 3, the center portion of the lower mold 130 and the lower supporting base plate 134 receive an upper cylindrical shot sleeve or cylinder 144, and a lower shot sleeve or cylinder 145 extends through a center opening within the lower platen 18 to define a shot chamber 146. The upper shot cylinder 144 has a bottom flange secured to the base plate 134, and the lower shot cylinder 145 has an upper flange secured to the lower platen 18. The upper end of the shot cylinder 145 has an upwardly projecting annular lip which is received within a corresponding mating cavity within the lower end of the shot cylinder 144 to form an interfitting connection or coupling 147. When the upper mold 100 is retracted upwardly to the mold open position (FIG. 1), the upper mold 100 and the lower mold 130 and their supporting base plates 44 and 134 may be released by extension of the pistons 84 to release the shot cylinder coupling 147 and permit the molds and attached base plates to be rolled horizontally as a set from the platens 18 and 44 for replacing or interchanging the molds.

Figure 4:
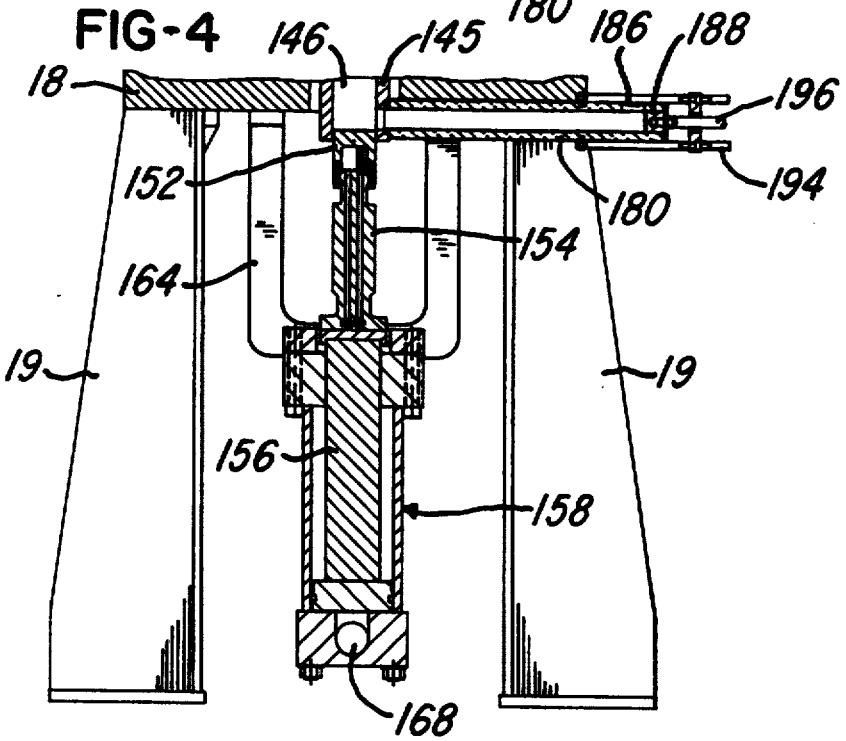
FIG. 4 is a vertical section of the lower portion of the press shown in FIG. 1.

Referring to FIGS. 3 and 4, a water cooled shot piston 152 is supported for vertical movement within the shot sleeves or cylinders 144 and 145, and the piston 152 is connected to an upper extension 154 of a piston rod 156 supported within a hydraulic cylinder 158. The cylinder 158 is supported by a pair of U-shaped brackets 164 which depend from the lower platen 18 between the leg pedestals 19. The piston rod 156 extends upwardly from a piston 156 within the cylinder 158. When hydraulic fluid is supplied to the inlet 168 of the hydraulic cylinder 158, the piston rod 156 and rod extension 154 move upwardly so that the shot piston 152 moves from its lower retracted position (FIGS. 3 and 4) to an upper position adjacent the top of the shot cylinder 144.

As also shown in FIGS. 3 and 4, molten die cast metal is transferred or supplied to the chamber 146 within the shot cylinder 145 through a tubular transfer cylinder 180 which extends laterally or horizontally from the shot cylinder 145 within a part-cylindrical recess 182 formed within the bottom surface of the lower platen 18. Preferably, the transfer cylinder 180 is constructed of a ceramic material known as alumina titanate which is non-wetting and permits substantially no heat transfer. The cylinder passage defined by the cylinder 180 connects with a port 184 within the shot cylinder 145, and an inlet port 186 is formed within the top of the transfer cylinder 180 adjacent a transfer piston 188 shown in its retracted position in FIG. 4. A hydraulic cylinder 192 (FIG. 2) is supported in a horizontal position by a set of tie rods 194 which extend from the lower platen 18. The cylinder 192 includes a piston rod 196 which extends from a piston within the cylinder 192 and has an outer end portion secured to the piston 188 within the transfer cylinder 180.

In operation of the die casting machine or press described above, molten die cast metal, such as molten aluminum, is transferred from a furnace (not shown) by an automatic ladle system (not shown) and poured into the inlet 186 of the transfer cylinder 180. After a predetermined volume is poured into the transfer cylinder 180 through the inlet 186, the hydraulic cylinder 192 is actuated to extend the piston 188 inwardly for transferring the molten metal from the transfer cylinder 180 into the chamber 146 of the shot cylinder 145. Typically, the molten material may have a temperature of 1300° F. as it is poured into the inlet 186, and the temperature remains constant within the transfer cylinder 180 since there is no heat loss through the ceramic material forming the cylinder 180. As soon as the molten material is transferred into the chamber 146 defined by the shot cylinder 145, the hydraulic cylinder 158 is actuated so that the shot piston 152 moves upwardly within the cylinders 145 and 144 to inject the molten metal through a set of runners 202 within the upper mold 100 and into the cavities 108. The injection pressure produced by the shot piston 152 is in the order of 3,000 p.s.i. which is relatively low when compared with the injection pressure of about 15,000 p.s.i. commonly required within a horizontal die casting machine or press.

After the molten material solidifies within the cavities 108 to form the die cast parts P and within the runners 202 and top portion of the shot cylinder 144 by cooling water circulated within passages (not shown) within the upper mold 100 and lower mold 130, the hydraulic pressure on the load cell or piston 52 is released, and the locking blades 66 are retracted inwardly. The upper platen 34, the intermediate platen 44 and the upper mold 100 are then shifted upwardly between the columns 22 to open the mold. The solidified parts P within the cavities 108 and the solidified metal within the runners 202 move upwardly with the upper mold 100. The die cast parts P and the connecting runners are ejected downwardly from the cavities within the upper mold 100 by actuation of the hydraulic ejector cylinder 122 which moves the piston 119, bumper plate 112 and ejector pins 114 downwardly.

From the drawings and the above description, it is apparent that a vertical die casting press constructed in accordance with the present invention provides desirable features and advantages. One important feature is provided by rapidly transferring the molten metal into the shot cylinder 145 with the transfer cylinder 180 instead of pouring the molten material into the shot cylinder. As a result, the cycle time for the molding operation is significantly reduced and this permits higher speed production of die cast parts. For example, in one testing operation, the cycle time was reduced from 30 seconds to 24 seconds, representing about a 20% shorter cycle time. In addition, the construction of the transfer cylinder 180 from the ceramic material of alumina titanate, eliminates any heat loss while the molten metal is being poured into the transfer cylinder 180 and while the metal is being transferred from the cylinder 180 into the shot cylinder 145 by the piston 188. The ceramic material is also non-wetting so that the molten metal does not adhere to the ceramic material and thereby avoids any degradation of the injected metal over a period of use. The transfer operation is also performed while the upper mold 100 is closing on the lower mold 130 in order to minimize cycle time.

The lateral transfer of the molten metal and the upward injection of the metal into the mold cavities is also effective to degas the molten metal, thereby minimizing porosity of the solidified die cast parts. Preferably, a light suction is applied to the cavities 108 and runner 202 and the injecting chamber 146 to remove air from the chamber and to remove the gas separated from the molten metal within the shot cylinder.

The base plates 94 and 134 on the upper mold 100 and lower mold 130, respectively, also cooperate with the hydraulically actuated pistons 84 within the platens 18 and 44 to provide for quickly removing a mold set from the press and for inserting a new mold set. This quick interchange of tooling is especially desirable when using the press for molding a variety of different parts. Another feature is provided by the adjustable positioning of the upper platen 34 with the retractable locking blades 66 and the locking plates 26 and with the use of the load cell or hydraulic piston 52 within the upper platen 34. This structure provides for quickly moving the upper mold 100 between its upper retracted or open mold position and its lower mold closed position where the upper mold 100 clamped against the lower mold 130 by the load cell or piston 52. This structure also permits the use of mold sets of different heights according to the size of the parts and helps in minimizing the cycle time of the press.

While the method and form of die casting apparatus herein described constitute a preferred embodiment of the invention, it is to be understood that the invention is not limited to the precise method and form of apparatus described, and that changes may be made therein without departing from the scope and spirit of the invention as defined in the appended claims.

The invention having thus been described, the following is claimed:

1. A vertical die casting press comprising a generally horizontal lower platen supporting a lower mold, a generally horizontal upper platen supporting an upper mold, means for moving said upper platen vertically relative to said lower platen for moving said upper and lower molds between open and closed positions, means defining a generally vertical shot chamber within said lower platen and said lower mold, a base plate connected to at least one of said molds, means defining a set of parallel spaced tracks connected to said base plate, a plurality of hydraulically activated cylinders within the platen which supports said one mold said cylinders including means supporting a set of rollers for engaging said tracks to provide for convenient lateral removal of said one mold and the corresponding said base plate as a unit, a shot piston movable within said shot chamber, means for supplying molten material into said shot chamber, and means for moving said shot piston upwardly within said shot chamber for injecting the molten material received within said shot chamber upwardly into at least one cavity defined by said upper and lower molds.

2. A die casting press as defined in claim 1 wherein said means for supplying molten material into said shot chamber comprise a ceramic transfer cylinder projecting laterally from said shot chamber, a transfer piston movable within said transfer cylinder, and means for moving said transfer piston within said transfer cylinder.

3. A die casting press as defined in claim 1 and including an intermediate platen disposed between said upper and lower platens and supporting said upper mold, means for connecting said intermediate platen to said upper platen and providing for vertical movement of said intermediate platen relative to said upper platen, and a hydraulically actuated piston within said upper platen and positioned for pressing downwardly on said intermediate platen for positively holding said upper mold against said lower mold in a closed position.

4. A die casting press as defined in claim 3 wherein said upper mold supports a plurality of stripper pins for vertical movement within said cavity, and means including a hydraulic cylinder within said intermediate platen for moving said stripper pins downwardly to eject a die cast part from said mold cavity.

5. A die casting press as defined in claim 1 and including a pair of generally flat horizontally spaced vertical columns connected to said lower platen and projecting upwardly with said upper platen disposed between said columns, and hydraulically actuated means for releasably locking said upper platen to said columns at selectable different elevations.

6. A vertical die casting press comprising a generally horizontal lower platen supporting a lower mold, a generally horizontal upper platen supporting an upper mold, means for moving said upper platen vertically relative to said lower platen for moving said upper and lower molds between open and closed positions, means defining a generally vertical shot chamber within said lower platen and said lower mold, a shot piston movable within said shot chamber, a transfer cylinder extending laterally from said shot chamber and having an inlet for receiving molten die cast material, a transfer piston movable within said transfer cylinder, means for moving said transfer piston for transferring the molten material from said transfer cylinder into said shot chamber, means for moving said shot piston upwardly within said shot chamber for injecting the molten material received within said shot chamber upwardly into at least one cavity defined by said upper and lower molds, a base plate connected to at least one of said molds, means defining a set of parallel spaced tracks connected to said base plate, a plurality of hydraulically actuated cylinders within the supporting said platen, and said cylinders including retractable means supporting a set of rollers for engaging said tracks to provide for convenient lateral removal of said one mold and said base plate as a unit.

7. A die casting press as defined in claim 6 wherein said transfer cylinder comprises a body of ceramic material to provide said heat insulating material for preventing heat loss from the molten material within said transfer cylinder.

8. A die casting press as defined in claim 7 wherein said ceramic material comprises alumina titanate.

9. A die casting press as defined in claim 6 and including an intermediate platen disposed between said upper and lower platens and supporting said upper mold, means for connecting said intermediate platen to said upper platen and providing for vertical movement of said intermediate platen relative to said upper platen, and a hydraulically actuated piston within said upper platen and positioned for pressing downwardly on said intermediate platen for positively holding said upper mold against said lower mold in a closed position.

10. A die casting press as defined in claim 9 wherein said upper mold supports a plurality of stripper pins for vertical movement within said cavity, and means including a hydraulic cylinder within said intermediate platen for moving said stripper pins downwardly to eject a die cast part from said mold cavity.

* * * * *